US006158593A

United States Patent [19]

Olsen

[11] Patent Number: 6,158,593

[45] Date of Patent: Dec. 12, 2000

[54] BALL HOLDING DEVICE AND METHOD OF USE

[76] Inventor: Steven H. Olsen, 27 Brindisi, Laguna Niguel, Calif. 92677

[21] Appl. No.: 09/289,144

[22] Filed: Apr. 8, 1999

[51] Int. Cl.[7] ..... A47F 7/00; A47F 5/08

[52] U.S. Cl. ..... 211/14; 211/85.7; 211/113; 206/315.9

[58] Field of Search ..... 211/14, 35, 85.7, 211/113; 206/315.9, 315.91; D6/552, 553

[56] References Cited

U.S. PATENT DOCUMENTS

| | | | |
|---|---|---|---|
| D. 389,688 | 1/1998 | Iacono | D6/552 |
| 2,270,796 | 1/1942 | Hauser | 211/35 X |
| 2,866,559 | 12/1958 | Byrne | 211/87.01 X |
| 4,119,247 | 10/1978 | Newquist et al. | 211/14 X |
| 4,561,547 | 12/1985 | Estwanik, III | 211/85.7 X |
| 4,654,991 | 4/1987 | Jones | 211/118 X |
| 4,693,402 | 9/1987 | Comeau | 224/215 |
| 5,027,960 | 7/1991 | Rainville | 211/85.7 X |
| 5,232,101 | 8/1993 | Shaftner et al. | 211/14 |
| 5,238,162 | 8/1993 | LaCivita | 224/250 |
| 5,341,928 | 8/1994 | Jones et al. | 206/315 |
| 5,553,707 | 9/1996 | Lion | 211/14 X |
| 5,615,769 | 4/1997 | Stephenson | 206/315.9 |
| 5,683,002 | 11/1997 | Rayside | 211/30 |
| 5,823,360 | 10/1998 | Gorosave | 211/13.1 |
| 5,829,604 | 11/1998 | Brophy | 211/85.7 X |
| 5,855,286 | 1/1999 | Zaid | 211/85.7 X |
| 5,950,844 | 9/1999 | Taylor | 211/85.7 |

*Primary Examiner*—Daniel P. Stodola
*Assistant Examiner*—Erica B. Harris
*Attorney, Agent, or Firm*—Eric Karich

[57] ABSTRACT

A ball holding device for holding at least one ball has a flexible support member. The flexible support member has a top hook attached to a rigid suspension rib at the top of the flexible support member. When the device is hanging from a structure, the rigid suspension rib functions to hold the flexible support member in an open configuration, thereby exposing a face of the flexible support member for use. The face has at least one ball support web, and preferably includes five ball support webs, allowing the device to store up to five balls of varying sizes. Each ball support web includes a rigid support rib positioned laterally across the flexible support member. A lateral ball retaining strap hangs from the flexible support member and is laterally spaced by the rigid support rib. A lateral base strap is sewn to the flexible support member. An adjustment end of the lateral ball retaining strap engages the lateral base strap through a pair of locking rings, thereby allowing adjustment of the length of the lateral ball retaining strap to fit the perimeter of the ball being stored. A flexible base strap connects the middle of the lateral ball retaining strap to the flexible support member, thereby forming a ball containment pocket. In its preferred embodiment, the flexible support member further includes a lateral sleeve positioned laterally across the front of the flexible support member sized to frictionally engage an air pump.

6 Claims, 1 Drawing Sheet

BALL HOLDING DEVICE AND METHOD OF USE

BACKGROUND OF THE INVENTION

1. Field of the Invention

This invention relates generally to a ball holding device, and more particularly to a ball holding device having a plurality of ball support webs as well as an attached air pump.

2. Description of Related Art

The following art defines the present state of this field: Parrilla, Sr., U.S. Pat. No. 4,002,241, describes a rigid plastic rack designed to be mounted on a wall for storing sporting equipment. Newquist, U.S. Pat. No. 4,119,247, describes a flexible and elastic tennis ball pocket designed to be fastened to a garment. Gorosave, U.S. Pat. No. 5,823,360, discloses a device for holding sports equipment, the device having a rigid connector supporting a plurality of ball racks or baskets. Rayside, U.S. Pat. No. 5,683,002, discloses a flexible hanging device having a plurality of slots for receiving the bills of baseball caps. Shaftner, U.S. Pat. No. 5,232,101, discloses a sports ball storage device having rigid U-shaped members that interconnect to form a ball holding unit. Stephenson, U.S. Pat. No. 5,615,769, discloses a sports ball bag.

The prior art teaches various ball-holding devices. However, the prior art does not teach a ball-holding device having a ball support web that can securely hold a ball of any common size and shape, while also holding the ball in a manner that makes the ball easy to remove and use. The prior art also does not teach a flexible device that can be easily stored, yet expands to a full-sized ball holding unit capable of holding a plurality of balls having varying diameters and shapes. The present invention fulfills these needs and provides further related advantages as described in the following summary.

SUMMARY OF THE INVENTION

The present invention teaches certain benefits in construction and use which give rise to the objectives described below.

The present invention provides a ball holding device for holding at least one ball. The device has a flexible support member having a connector means for connecting to another structure, preferably a top hook attached to the top of the flexible support member with a rigid suspension rib. When the device is hanging from a structure, the rigid suspension rib functions to hold the flexible support member in an open configuration, thereby exposing a face of the flexible support member for use. The face has at least one ball support web, and preferably includes five ball support webs, allowing the device to store up to five balls of varying sizes. Each ball support web includes a rigid support rib positioned laterally across the flexible support member. A lateral ball retaining strap hangs from the flexible support member, is laterally spaced by the rigid support rib, and includes a length adjusting means. A flexible base strap connects the middle of the lateral ball retaining strap to the flexible support member, thereby forming a ball containment pocket. In its preferred embodiment, the flexible support member further includes a lateral sleeve positioned laterally across the front of the flexible support member sized to frictionally engage an air pump.

A primary objective of the present invention is to provide a ball holding device having advantages not taught by the prior art.

Another objective is to provide a ball support web having a flexible three-part construction held open by a rigid support rib. This construction allows the ball support web to be easily adapted to fit a ball of any common sizes and shapes. This structure also allows balls to be quickly and easily inserted into and removed from the ball support web.

A further objective is to provide a ball holding device that collapses down to a small size for easy transportation and storage, yet expands to a full-sized ball holding unit capable of holding a plurality of balls having varying diameters and shapes.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
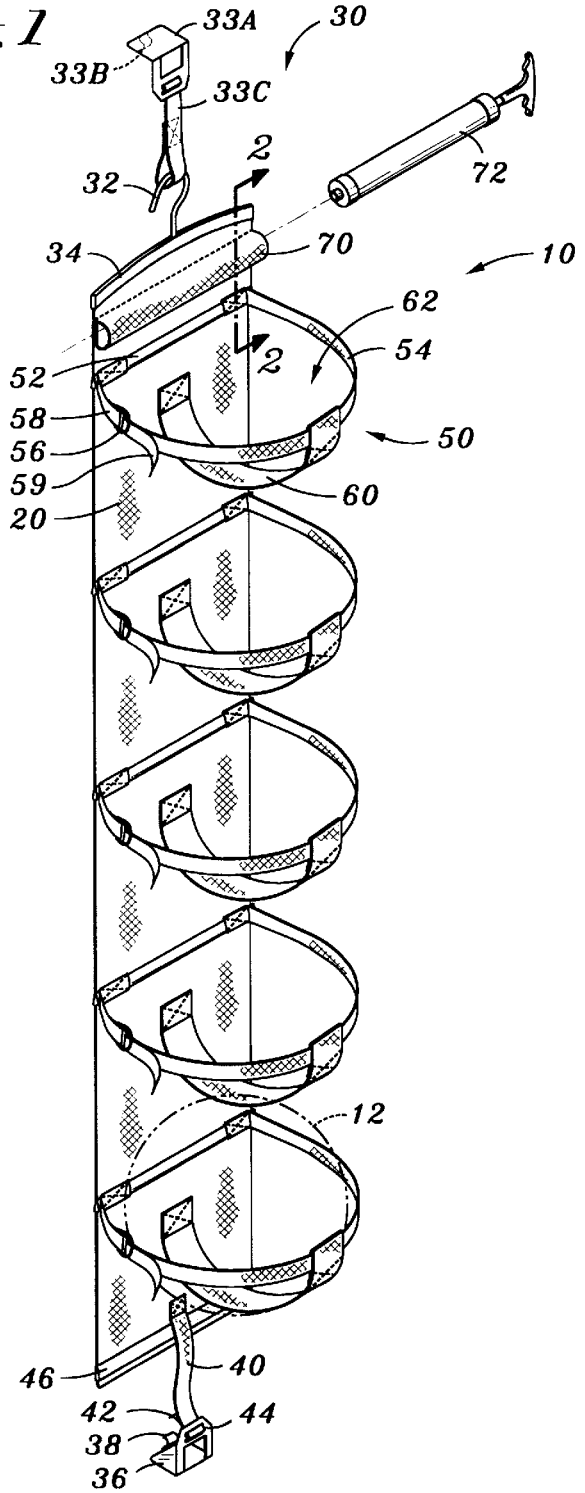
FIG. 1 is a perspective, partially exploded view of the preferred embodiment of the present invention.

The above described drawing figures illustrate the invention, a ball holding device 10 for holding at least one ball 12. As shown in FIG. 1, the device 10 has a flexible support member 20 having a connector means 30 for connecting to another structure ("connector means") and attaching the device 10 thereto. The flexible support member 20 is preferably formed with two layers of nylon 22*a* and 22*b* sewn together to form a rectangle approximately 6.5 feet tall and 10 inches wide. While these specifications make the device 10 well suited for hanging on the back of a door in a garage, these specifications can vary widely for different specific embodiments, all within the scope of this invention. While the device 10 is fairly large when installed, the flexible nature of the flexible support member 20 allows the device 10 to collapse down to a small size for transportation and storage of the device 10.

Figure 2:
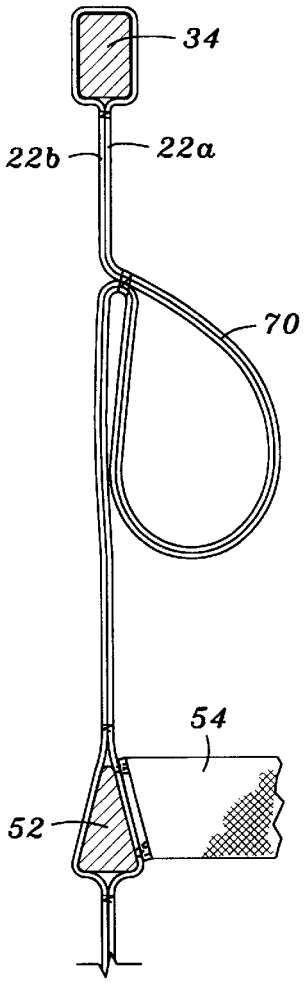
FIG. 2 is a sectional view thereof taken along line 2—2 in FIG. 1.

The connector means 30 preferably includes a top hook 32 attached to the top of the flexible support member 20. The top hook 32 is preferably made of metal, plastic, or other rigid and durable material, and is adapted to removably engage a wall hook attached to a wall (not shown). When hanging the device 10 on the back of a door, the connector means 30 preferably further includes a top door hook 33A having a resilient top locking portion 33B and a loop strap 33C. The top door hook 33A and the resilient top locking portion 33B are adapted to removably engage the top edge of a door. The top hook 32 then removably engages the loop strap 33C attached to a top door hook 33A, thereby suspending the device 10 from the top of the door. The top hook 32 is preferably attached to a rigid suspension rib 34. The rigid suspension rib 34 is preferably fixedly positioned between the two layers of nylon 22*a* and 22*b* that form the flexible support member 20, as shown in FIG. 2. When the device 10 is hanging from the top hook 32, the rigid suspension rib 34 provides lateral support to the flexible support member 20, thereby holding the device 10 in its expanded configuration for easy use.

When hanging the device from a door, the connector means 30 preferably further includes a bottom hook 36. The bottom hook 36, similar to the top door hook 33A, is preferably a plastic or metal hook having a resilient bottom locking portion 38 adapted to lock firmly onto the bottom edge of the door. The bottom hook 36 is preferably adjustably attached to the bottom of the flexible support member 20 with a means for adjusting 40 ("bottom hook adjustment means") the length of the bottom hook 36. The bottom hook adjustment means 40 is preferably a bottom strap made of inelastic material such as nylon. The bottom strap 40 is preferably sewn to the bottom edge of the flexible support member 20 and adjustably engages the bottom hook 36 through a pair of adjustment slits 44. The bottom strap 40 is preferably sewn to the flexible support member 20 in proximity to a rigid bottom rib 46 positioned laterally along the bottom edge of the flexible support member 20. The bottom rib 46 is preferably sewn between the two layers of nylon 22*a* and 22*b* in the same manner as the suspension rib 34. The bottom rib 46 provides lateral support for the device 10 in the same manner as the suspension rib 34.

In use, the top door hook 33A is hooked over the top edge of a door. The resilient top locking portion 33B conforms to the specific size and shape of the door, allowing the top door hook 33A to lock tightly in place. The top hook 32 is then hooked through the loop strap 33C, thereby hanging the device 10 from the top of the door. The suspension rib 34 provides lateral support for the flexible support member 20 as described above, thereby causing the device 10 to hang in its expanded rectangular shape. The bottom hook 36 is them hooked under the bottom edge of the door. The resilient bottom locking portion 38 conforms to the specific size and shape of the door, allowing the bottom hook 36 to lock tightly in place. The user then pulls the terminal end 42 of the bottom strap 40 until the flexible support member 20 is pulled tightly across the front of the door. The bottom rib 46 cooperates with the support rib 52 to maintain the flexible support member 20 in its open, rectangular shape, exposing a face of the flexible support member 20 for use as described below.

The face of the flexible support member 20 has at least one ball support web 50 attached thereto. The flexible support member 20 preferably includes five ball support webs 50, allowing the device 10 to store up to five balls 12 of varying size, however, this number can vary depending upon the specific embodiment of the device 10. For clarity, this description will describe a single ball support web 50. The ball support web 50 has a rigid support rib 52 positioned laterally across the flexible support member 20. As shown in FIG. 2, the support rib 52 is preferably a plastic rib sewn between the two layers of nylon material 22*a* and 22*b* of the flexible support member 20, as with the suspension rib 34. The ball support web 50 also contains a lateral ball retaining strap 54. The lateral ball retaining strap 54 hangs from the flexible support member 20 and is laterally spaced by the rigid support rib 52. The lateral ball retaining strap 54 includes a means for adjusting the length 56 ("length adjusting means") of the lateral ball retaining strap 54. The length adjusting means 56 is preferably a pair of locking rings sewn to a lateral base strap 58, the locking rings 56 being shaped for adjustably locking an adjustment end 59 of the lateral ball retaining strap 54. Finally, a flexible base strap 60 connects the middle of the lateral ball retaining strap 54 to the flexible support member 20, thereby forming a ball containment pocket 62. The flexible base strap 60 is preferably looped around the lateral ball retaining strap 54 and sewn to itself, thereby interlocking the flexible base strap 60 to the lateral ball retaining strap 54 while allowing the lateral ball retaining strap 54 to slide relative to the flexible base strap 60 when the lateral ball retaining strap 54 is adjusted. This configuration maintains the flexible base strap 60 attached to the center of the lateral ball retaining strap 54 even when the lateral ball retaining strap 54 is tightened.

The flexible support member 20 preferably further includes a lateral sleeve 70 positioned laterally across the front of the flexible support member 20 and sized to frictionally engage an air pump 72. The lateral sleeve 70, as shown in FIG. 2, is preferably formed by pinching a portion of the flexible support member 20 together and fastening it together to form the proper sleeve. An ordinary air pump 72 can then be inserted into the lateral sleeve 70 for convenient storage of the air pump 72 in proximity to the balls 12. Additional features can also be added to the device 10 to increase its utility. A elastic nylon mesh pouch (not shown) having an opening near its top edge can be sewn onto the face of the flexible support member 20 for holding small balls such as baseballs and tennis balls. Other features can be devised by those skilled in the art without deviating from the spirit of this invention.

The invention includes a method for storing a ball 12. The method comprises a series of steps. First, the user provides the ball storing device 10 described above. The user then hangs the flexible support member 20 from a door by attaching the connector means 30 to either a hook on the wall, the top edge of the door, or other suitable structure. When hooked to the top of the door, as described above, the user then hooks the bottom hook 36 under the bottom of the door. The user then tightens the bottom hook adjustment means 40 until the flexible support member 20 is stretched tightly against the door. A ball 12 is then inserted into the ball containment pocket 62 of the ball support web 50 so that the ball 12 rests on the flexible base strap 60 and is contained between the flexible support member 20 and the lateral ball retaining strap 54. The lateral ball retaining strap 54 is tightened with the length adjusting means 56 until the ball 12 is held firmly by the lateral ball retaining strap 54. In its preferred embodiment, the user accomplishes this by pulling on the adjustment end 59 of the lateral ball retaining strap 54, thereby tightening the lateral ball retaining strap 54 until it fits snugly around the perimeter of the ball 12. The benefit of this configuration is that the ball containment pocket 62 can be quickly and easily adjusted to hold a ball 12 of any size and shape. Furthermore, the rigid support rib 52 holds the lateral ball retaining strap 54 open to receive the ball 12. Finally, the ball 12 can be easily removed from the ball containment pocket 62 simply by pushing upwards on the ball 12 between the lateral ball retaining strap 54 and the flexible base strap 60, causing the ball 12 to pop out of the ball containment pocket 62.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A ball holding device for holding at least one ball, the device comprising:

(a) a flexible support member;

(b) a connector means for connecting the flexible support member to another structure and attaching the ball holding device thereto, the connector means being attached to a top of the flexible support member;

(c) at least one ball support web, each said at least one ball support web having:

a rigid support rib positioned laterally across the flexible support member;

a lateral ball retaining strap hanging from the flexible support member, opposing ends of said lateral ball retaining strap being laterally spaced by the rigid support rib;

a means for adjusting the length of the lateral ball retaining strap; and a flexible base strap connecting the middle of the lateral ball retaining strap to the flexible support member.

2. The device of claim 1 further comprising a lateral sleeve positioned laterally across the front of the flexible support member and sized to frictionally engage an air pump.

3. The apparatus of claim 1 wherein the connector means is a top hook attached to a suspension rib, the suspension rib being attached to the top of the flexible support member.

4. The apparatus of claim 3 further comprising a top door hook attached to a loop strap, and a bottom hook adjustably attached to the bottom of the flexible support member with a means for adjusting the bottom hook, the loop strap being adapted to removably engage the top hook.

5. A method for storing a ball, the method comprising the steps of:

a) providing a ball storing device, the device comprising: a flexible support member having a top hook attached to the top end of the flexible support member; and at least one ball support web, each said at least one ball support web having: a rigid support rib positioned laterally across the flexible support member; a lateral ball retaining strap hanging from the flexible support member, opposing ends of said lateral ball retaining strap being laterally spaced by the rigid support rib; a means for adjusting the length of the lateral ball retaining strap; and a flexible base strap connecting the middle of the lateral ball retaining strap to the flexible support member;

b) hanging the flexible support member by removably attaching the top hook to a structure;

c) inserting a ball into the ball support web so that the ball rests within the lateral ball retaining strap and on the flexible base strap; and d) tightening the lateral ball retaining strap with the length adjusting means until the ball is held firmly by the lateral ball retaining strap.

6. The method of claim 5 further comprising the steps of:

e) providing a bottom hook adjustably attached to the bottom end of the flexible support member with a means for adjusting the length of the bottom hook;

f) providing a top door hook having a resilient top locking portion, the top door hook having a loop strap;

g) attaching the top door hook to the top of a door, the resilient top locking portion engaging the top of the door;

h) removably engaging the top hook to the loop strap of the top door hook;

i) attaching the bottom hook to the bottom of a door, the resilient bottom locking portion engaging the bottom of the door; and j) tightening the means for adjusting the bottom hook until the flexible support member is stretched tightly against the door.

* * * * *